US007356960B1

(12) United States Patent
Knitt

(10) Patent No.: US 7,356,960 B1
(45) Date of Patent: Apr. 15, 2008

(54) FIREARM SUPPORT ASSEMBLY

(76) Inventor: Curt Thomas Knitt, E5861 Herzberg Rd., Marion, WI (US) 59450

( * ) Notice: Subject to any disclaimer, the term of this patent is extended or adjusted under 35 U.S.C. 154(b) by 575 days.

(21) Appl. No.: 11/031,553

(22) Filed: Jan. 7, 2005

(51) Int. Cl.
*F41A 27/00* (2006.01)

(52) U.S. Cl. ..... 42/94; 89/37.04

(58) Field of Classification Search ..... 42/94; 89/37.04

See application file for complete search history.

(56) References Cited

U.S. PATENT DOCUMENTS

| | | | | |
|---|---|---|---|---|
| 50,597 | A | 10/1865 | Jones | |
| 324,555 | A | 8/1885 | Hish | |
| 797,376 | A | 8/1905 | Schneider, Sr. et al. | |
| 1,457,407 | A | 6/1923 | Stokes | |
| 2,316,995 | A | 4/1943 | Smith | |
| 2,427,365 | A | 9/1947 | Meister | |
| 2,870,683 | A | 1/1959 | Wilson | |
| 2,981,509 | A | 4/1961 | Messenger et al. | |
| 3,041,938 | A | 7/1962 | Seabrook | |
| 3,225,656 | A * | 12/1965 | Flaherty et al. | 89/37.04 |
| 3,361,265 | A | 1/1968 | Wernimont | |
| 3,473,673 | A | 10/1969 | Porter | |
| 3,477,587 | A | 11/1969 | Hart | |
| 3,827,172 | A | 8/1974 | Howe | |
| 4,007,554 | A * | 2/1977 | Helmstadter | 42/94 |
| 4,026,057 | A | 5/1977 | Cady | |
| 4,449,314 | A | 5/1984 | Sorenson | |
| 4,548,392 | A * | 10/1985 | Rickling | 269/156 |
| 4,558,531 | A | 12/1985 | Kilby | |
| 4,621,563 | A | 11/1986 | Poiencot | |
| 4,807,381 | A | 2/1989 | Southard | |
| 4,824,086 | A | 4/1989 | Rickling | |
| 4,876,814 | A | 10/1989 | Lombardo | |
| 4,924,616 | A | 5/1990 | Bell | |
| 4,998,944 | A | 3/1991 | Lund | |
| 5,056,410 | A | 10/1991 | Pitts | |
| 5,081,783 | A * | 1/1992 | Jarvis | 42/94 |
| 5,299,896 | A | 4/1994 | Ferri | |
| 5,419,233 | A | 5/1995 | Mulvaney | |
| 5,617,666 | A | 4/1997 | Scott | |
| 5,628,135 | A | 5/1997 | Cady | |
| 5,661,919 | A | 9/1997 | Pryor | |
| 5,794,899 | A | 8/1998 | Tamllos | |
| 5,937,561 | A | 8/1999 | Abernethy | |
| 6,044,747 | A | 4/2000 | Felts | |
| 6,269,578 | B1 * | 8/2001 | Callegari | 42/94 |
| 6,305,117 | B1 | 10/2001 | Hales, Sr. | |
| D471,248 | S | 3/2003 | Jacobs | |
| 6,526,687 | B1 * | 3/2003 | Looney | 42/94 |

(Continued)

*Primary Examiner*—Troy Chambers
(74) *Attorney, Agent, or Firm*—Loyd W. Bonneville, Attorney

(57) ABSTRACT

Height and length are adjustable at several points. There is a special type of vise for holding the gunstock. As usual, the vise bolt pulls the movable plate toward the fixed one but, like some of the vise's predecessors, traces out an arc at the top, pivoting from the bottom as the bolt, situated just above the pivot, is turned. Within the movable plate a special cylinder is situated which gives and turns freely in response to the bolt's advance and withdrawal in passing through a threaded tunnel within it. This action prevents the biting down or binding upon the bolt which would otherwise occur because of the plate's pivoted travel as the bolt is advanced or withdrawn. The support's framework, best made from economical tubular bar-stock, is adjustable for leveling and leaning corrections and include anchoring blocks within the structure through which leveling bolts pass.

17 Claims, 10 Drawing Sheets

U.S. PATENT DOCUMENTS 6,761,101 B1 7/2004 Luth
6,877,266 B1 * 4/2005 Brownlee ..... 42/94
6,931,777 B1 * 8/2005 Krien ..... 42/94

* cited by examiner

FIREARM SUPPORT ASSEMBLY

BACKGROUND OF THE INVENTION

1. Field of the Invention

Firearm Accessories

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term cradle positioning sleeve (53) might be used in one instance but in another, if meaning is otherwise clear from context, expression might be shortened to positioning sleeve (53) or merely sleeve (53). Any of those forms is intended to convey the same meaning.

The term attach or fasten or any of their forms when so used means that the juncture is of a more or less permanent nature, such as might be accomplished by nails, screws, welds or adhesives. Thus it is stated herein that the cradle's barrel rest (51) connection to the cradle neck (52) is one of attachment, for which purpose welding is the preferred means. A connection in which one object is easily removed from another is described by the word emplace, as where it is stated herein that the vise lag cylinder (67) is emplaced during assembly within the vise's movable plate (63). A connection in which two objects, although not attached could be separated only with at least some degree of difficulty is referred to herein as one of rigid emplacement. The adjustable connections made by means of the positional sleeve and set pin subassemblies (4, 60) are stated herein to provide such a connection. Employment of the words connect or join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the outer fitting member of a positioning sleeve and set pin subassembly (4, 60) comprises a sleeve (53, 75, respectively) which fits reasonably closely—in near-snugness around an inner rod-like one (31, 12, respectively), meaning that the latter—the subassembly's sleeve (53, 75, respectively)—is in fact the former—the outer fitting member. The term comprise may also be characterized by what might be considered one-way equivalency, as when it is stated herein that the inwardly disposed surface of the vise's fixed plate (62) comprises an acceptable stop for end of the spring's (66) proximate that plate (62), meaning that in the given instance, the inner surface of the fixed plate (62) was itself the stop. This use of the word has a generic sense to it. That is, the fixed plate's (62) inner surface would always serve as a spring stop but the spring stop could be that surface in one case but something else (73) in another. However, the word comprise may also be used to describe a feature which is part of the structure or composition of a given object. Thus, it is stated that the assembly's cradle (5) comprises a horizontally disposed firearm barrel rest (51) as a member thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the assembly and its components in the manner they would ordinarily be observed if situated for use. This convention has been adopted as a matter of convenience in discussing orientation. Thus, it is stated that the cradle (5) is disposed atop a vertical extension (31) of the assembly's front support (3), which (3) together with the maximal force-attenuated third class vise (61) disposed at the rear are described as upwardly extending elements; the cradle sleeve (53) is disposed to be slid up or down upon the extension (31); and the vise plates (62, 63) are occasionally spoken of in terms of their upper extremities. In like respects, the inward surface of the vise's fixed plate (62) is recognized as an acceptable stop for its coil-spring (66) and that the movable plate (63) is operably tipped outward or inward in response to the retraction bolt's (65) advance or withdrawal. Forwardly disposed, of course, means toward the front. Orientational adverbs of this sort remain valid as convenient attitudinal references even under differing circumstances, as where the assembly might hypothetically be considered during inversion—turned upside down for examination, for example.

The expression T-shaped describes the configuration of a structure comprising a longitudinal extension, or component, and a generally orthogonally disposed lateral one, whose mid-portion is intersected by an end of the longitudinal one.

The term firearm (100) includes not only long-barreled shooting devices but a pistol as well.

The phrase diametrically disposed means passing through the center of an object's axial cross-section. Herein, it is used to characterize the passage of the movable plate's lag cylinder threaded tunnel (68), in its (68) preferred alignment through the lag cylinder (67).

The shorthand term biased appears in connection with the vise's coil-spring (66), wherein it is said that the vise plates (62, 63) are biased apart by it (66), meaning merely that the plates (62, 63) are pushed apart by it (66) in its (66) sought-for, or naturally attained, state of expansion. More scientifically stated, the biased apart coil-spring (66) when compressed, or closed, may be considered to portray a potential energetic state, which (66) upon expansion—having been released, or sprung open—reposes in a kinetic one.

The term bar-stock denotes commercially available building materials elongated in extension either solid (19) or tubular in configuration (13, 14) so as to provide feasible means for framework building. Tubular bar-stock comprises a hollow tunnel-like interior along its length but in cross-section may comprise any configuration such as square (13) or round (14). Such is also the case for solid (19) members. Hollow material suitable for construction of particular members, such as the vise plates (62, 63), for example, may acceptably be rectangular in cross-section.

The word positioning herein does not refer merely to overall or main-stem emplacement, shifting or propping up of the entire assembly at a desired elevation or azimuth but rather, refers to operationally controlled adjustments which raise, lower or extend a particular portion thereof only. Longitudinal positioning, for example, effects shortening or lengthening the distance between the front and rear support points (3, 6, respectively) to accommodate, for example, the length of a particular firearm (100) as opposed merely to moving, or relocating, the assembly forward or backward. Features providing rough and fine positioning, where present, refer to the relative degree of adjustment undertaken to set the mounted firearm (100) at the desired attitude. Rough positioning means connotes an approximate setting and fine positioning, a more precisely fixed one. Fine vertical positioning assemblies (7), well known in the art, have generally been stationed at strategic points upon or beneath the structure they have supported. As a matter of definition herein, each (7) included a support level pin (91) configured to engage a threaded aperture in the structure for height and other adjustments.

Certain words have been coined herein to simplify discussion. In some cases, a verb is converted to a noun or adjective and, perhaps, vice-versa. Moreover, a verb may also undergo convenient conversion to an adverb herein by addition of the suffix -al, -ly and the like if the modified result does not become too cumbersome a creation. Thus, expressions such as orientational and forwardly make an occasional appearance. And, to avoid redundancy, the expression more or less might be used at times in equivalence for generally or approximately.

The term interthread denotes the engagement of one threaded object—say, a bolt—with another—a nut, for example—whose threads are complementary to those of the first so that, in the usual case where the engagement is tight, the two become mutually attached. Where the fit is slightly loosened, however, the objects co-engage so that, instead of locking together, one is caused to move easily upon the other in advancement or withdrawal. The principle of screw retraction is further addressed herein, ante.

Similarly, the coined term rotable and derivations thereof refer to an object's capability to be turned upon an axis it comprises, as where it is stated herein that the vise lag cylinder (67) is rotably disposed within a vise oval tunnel (69) comprised by the movable plate (63). The term rotational is instead reserved for objects impelled in some manner to spin, or rotate, in an operably continual manner.

The term enwrap and derivations thereof such as enwrapment denote an enfolding disposition, such as where it stated herein that a coil-spring (66) longitudinally enwraps the vise's retraction bolt (65). This means merely that the spring (66) is disposed to allow the bolt (65) to extend, or run, through the tunnel it (66) is configured to comprise, being retained in place by appropriate means—spring stops (73) and the like—and that the spring (66) is disposed to surround or sheath the enwrapped object in a proximal or reasonably close manner. The transitive verb envelope and its derivations is related also in an essentially equivalent manner. To avoid confusion with its more favored optical far-seeing sense, the word telescope is not employed herein to describe the lengthwise insertion of a part into one or more other collapsible ones. Such arrangements are instead described in the foregoing terms by saying, for example, that a vertical positional sleeve and set pin subassembly (4) is disposed to engage in longitudinally enveloping fashion the terminal of the front support's vertical extension (31) at a positioning sector; or, it can be stated even more simply that an outer fitting member comprises a sleeve which fits reasonably closely—in near-snugness, or in hand-in-glove fashion—around an inner rod-like one with just sufficient clearance to slide over it in advancement or withdrawal.

The word tunnel is an example of noun and verb interconversion. In familiar parlance, it denotes an elongated cavity or hollow within an object. It is often used equally well as a verb herein, however, with tunnels or tunneled as variations in expression—in much the same manner one might speak of a hollowed longitudinal object. The tunneled screw anchoring channel block (98) is, accordingly, addressed herein, ante.

It seems there are areas of commerce in which innovation is considered already to have dominated, preempting—or at least resisting—new entries, as it were. At the same time, however, one perceives other sectors in which imaginative variations of their already diverse populations are welcomed. This, applicant supposes, may well be a matter of social context—a concession to what is in vogue in a given succession of generations. In any case, the field of sport-related firearms (100) and accessories pertinent to them still appears to be no less responsive to incremental novelties than it ever was.

Gun stands, racks, bench stands, standards, supports or rests, all alternative expressions of equivalence concerning the subject matter hereof, have been devised to address several ends including stowage, repair, passive sighting alignment, shoot-checking alignment, hunting fore-stock support, recoil arrest, shoot-training and even merely exhibition. Several are designed with more than one of those purposes in mind. The term firearm support does not, of course, mean that the assembly could not be used for some other object such as an archery bow.

The underlying structure may be a singular pedestal, or standard, or two-point support; and which of those alternatives is provided may well depend upon which of the foregoing objectives are most sought after. In that connection, the structure may incorporate positioning features—either rough or fine or, perhaps, both. It may also provide for greater or lesser retention intensity—that is, where there is concern whether the firearm should be strongly gripped or merely permitted to repose in place.

Two-point support arrangements included U.S. Pat. No. 1,457,407 issued to Stokes; U.S. Pat. No. 3,361,265 issued to Wernimont; U.S. Pat. No. 2,981,509 issued to Messenger, et al.; U.S. Pat. No. 2,326,995 issued to Smith; U.S. Pat. No. 3,041,938 issued to Seabrook; U.S. Pat. No. 3,827,172 issued to Howe; U.S. Pat. No. 3,477,587 issued to Hart; U.S. Pat. No. 4,026,057 issued to W. Cady; U.S. Pat. No. 4,449,314 issued to Sorensen; U.S. Pat. No. 4,621,563 issued to Poiencot; U.S. Pat. Nos. 4,807,381 and 4,873,777 issued to Southard; U.S. Pat. No. 4,824,086 issued to Rickling; U.S. Pat. No. 4,876,814 issued to Lombardo; U.S. Pat. No. 4,924,616 issued to Bell; U.S. Pat. No. 4,998,944 issued to Lund; U.S. Pat. No. 5,056,410 issued to Pitts; U.S. Pat. No. 5,419,233 issued to Mulvaney; U.S. Pat. No. Des. 364,080 issued to Weyrauch; U.S. Pat. No. 5,628,135 issued to R. Cady; U.S. Pat. No. 5,661,919 issued to Pryor; U.S. Pat. No. 6,305,117 issued to Hales; U.S. Pat. No. 6,526,687 issued to Looney; and U.S. Pat. No. Des. 471,248 issued to Jacobs.

Singular standards included U.S. Pat. No. 2,427,365 issued to Meister; U.S. Pat. No. 2,870,683 issued to Wilson; U.S. Pat. No. 3,473,673 issued to Porter; U.S. Pat. No. 4,007,554 issued to Helmstadter; U.S. Pat. No. 4,558,531 issued to Kilby; U.S. Pat. No. 5,299,896 issued to Ferri, U.S. Pat. No. 5,617,666 issued to Scott; U.S. Pat. No. 5,794,899 issued to Tamllos; U.S. Pat. No. 5,937,561 issued to Abernethy; U.S. Pat. No. 6,044,747 issued to Felts; and U.S. Pat. No. 6,761,101 issued to Luth.

References particularly material to vise-like constructions in their own right included U.S. Pat. No. 50,597 issued to Jones; U.S. Pat. No. 324,555 issued to Hish-comprising spring biased un-clamping means; and U.S. Pat. No. 797,376 issued to Schneider.

Altogether non-positioning supports included Smith, Wernimont, Hart, the Southard pair, Pitts and Weyrauch, supra. Wernimont, the Southard pair and Weyrauch were all simple woodwork constructions which, by reason of their simplicity, addressed only the more rudimentary of the pertinent objectives. Smith provided merely a stowage frame for use in law enforcement. The Pitts device measured test firing recoil.

Inter-relational longitudinal positioning was present in many two-point support assemblies. It was absent in some of them, however, including Sorensen, Poiencot, Lund, R. Cady and Hales, supra, as they were generally in the singular support devices. Such positioning has to be considered inherently present, of course, in any singularly supported assembly in which the firearm (100) muzzle was not locked down upon its support and the butt was merely emplaced upon an independent movable support of any sort—including a human shoulder—or resting upon the underlying surface such as a bench-top or the ground. Examples included Kilby and Scott. By the same token, those rudimentary arrangements inherently provided pitch positioning, ante, in the same way. Although Felts—another singularly supported arrangement—comprised no inter-relational longitudinal positioning, it did comprise emplacement holes for longitudinally repositioning the entire unit—that is, as an overall adjustment.

Independent front end vertical positioning, distinguished from that incidentally provided by reason of pivotal adjustments in pitch or from main-stem or overall elevational changes, were provided in Stokes; Wilson; Seabrook; Howe—incidental by reason of a turnbuckle; W. Cady; Sorensen—another wood-crafted item; Kilby; Rickling; Bell; Lund; Mulvaney, R. Cady; Pryor; Abernethy; Felts; Hales, Looney; and Jacobs.

Independent rear end vertical positioning was provided for in Wilson, Sorensen, Howe, Rickling, Lombardo, Bell, Lund, Mulvaney, R. Cady, Hales, Looney and Jacobs.

Overall elevational changes were provided for in Stokes; Meister; Wilson; Helmstadter; Scott—a scissor-jack arrangement; and Felts.

In addition to those assemblies inherently permitting pitch adjustments because either the firearm (100) could be vertically pivoted within a vise, such as in Luth, or its parts merely rested unfastened upon something, supra, as in Scott and others, pivotal pitch positioning was provided for in Meister; Helmstadter; and all tripod, or transit, supported assemblies such as Wilson; Poiencot; and Tamllos—ball and socket.

While many of the devices provided azimuth positioning as well, such as Stokes, Helmstadter, Tamllos, Looney and others, this capability is not presently addressed in detail herein, considering the ease with which any portable rack or stand of the sort featured herein may be turned to point in the direction desired—that is, quickly and generally positioned in an ad hoc or simplified pragmatic sense.

The control capabilities over vertical positioning, whether at the front or rear, was only rough in many cases but quite finely tuned in others—again, depending most likely upon the purposes to which the assembly was dedicated. Fine vertical positioning, it was learned, could be best controlled by disposing the positioning points laterally with respect to one another. It was recognized that such arrangements should incidentally also permit adjustments for camber. In a few cases, therefore, a T-shaped framework (1) with screw-adjustment feet (7) was wisely devised. Examples included Kilby, Bell, Abernethy, Looney and Jacobs.

Whatever the arrangement of positioning or adjustment controls, however, depending upon anticipated use, the matter of firearm (100) in-place fixation was often considered essential. It was important in those cases to provide an effective clamp or vise. Examples exhibiting a simple but effective clothespin type clamp spring—that is, one which is biased shut and disposed to urge opposing levered handles closed against one another—were provided by Messenger, et al in a fishing pole support system and Lund in a more pertinent firearm bench rest. Wilson employed a spring-loaded hinge clamp operating merely upon first degree lever dynamics. The Porter device provided a cam-operating lever which, in vise-like fashion, impinged upon a clamping leaf spring, securing a stowed firearm (100) tightly within a vehicle. Poiencot comprised a butt impinging bolt. Ferri comprised muzzle hugging envelopment by complementary configured sections—that is, a hand-in-glove fitting—clamped in place. Felts incorporated a padded impinging finger disposed to force the butt against a stationary clamp wall.

Still popular today, the now ancient vise—or equally correct vice—operably drove a movable clamping ear or plate (63) against a parallel immobile, or fixed, one (62), pulling the former (63) against the latter (62) generally by means of a large retraction bolt (65) passing through tunnels (69, 74, respectively) in both (62, 63), operating by means of recognized screw retraction principles. The bolt (65) comprised a mid-shank configured to interthread with the movable plate (63) but to merely turn freely within the fixed one (62). This simple retention arrangement was employed in Meister, Weyrauch, Pryor and Tamllos. Usually, the vise plates (62, 63) were solid pieces but where portability and economy became issues, hollow construction was sometimes adopted. It was also observed, however, that the inclusion of mechanical leverage in vise action provided additional benefits.

In leverage systems (500), there is at work an indirectly proportional relationship between distance and force—an interrelated sacrifice of one for the other, if you will. Levers have been traditionally considered in three major respects. The first class lever provides mechanical advantage by disposing the fulcrum (200)—or pivot point—between the applied force (202) and the load (201). As youthful engagements with the playground teeter-totter or middle ages military operation of the deployed catapult have taught, the closer the fulcrum (200) is to the applied force (202), the more easily and farther the load responds to it (202). The second class lever contemplates prying activity, emplacing the load (201) between the fulcrum (200) and the locus of applied force (202). Then, the force (202) is required to act through a greater distance than that through which a considerably greater load (201) is moved. In the third class lever, the force (202) is exerted between the fulcrum (200) and the load (201). While substantially more work is required, the load (201) moves comparatively farther than the distance the force (202) operates through.

It is also appropriate here to discuss the principle of screw retraction alluded to supra, because that is the phenomenon by which the vise bolt (65) operates. The advancement and withdrawal of the screw into wood or some other substrate it can "tap" into—as it is sometimes said—is a commonly witnessed mechanical event. As the helical threads turn, the screw is urged forward or backward, depending upon direction of the applied force in relation to that of the helical thread. Convention generally runs it clockwise in a downwardly directed manner. Given enough turns, the screw will advance all of the way up to its shoulder. If the screw is maintained in place so that it is prevented from moving longitudinally—that is, advancing or withdrawing—the medium impaled by it, if free to do so, will instead itself rotate around the screw.

Workable though the traditional vise had always been, whether to secure the butt of the firearm (100) or for any other purpose, Jones and Hish disposed a cammed lever at or slightly below a non-retracting bolt joining the two plates (62, 63). Although the camming force itself illustrated merely first class leverage phenomena, the general disposition of the fulcrum (200), applied force (202) and work load (201) indeed represented third class lever vise (900) functionality, urging the movable plate's (63) upper end arcuately upon the fixed one (62). Schneider's vise, incorporating certain additional useful features, worked in like manner without the cammed impingement.

It was third class lever action which, in at least some vise models (900), substantially enhanced their (900) functionality. In situations in which it was useful to provide additional working space for the emplacement of objects between the vise plates (62, 63) and to open and close them (62, 63) quickly, application force (202) at the top of the plates (62, 63) could be sacrificed to gain levered distance there—that is, to quickly open or close them (62, 63).

Particular attention to construction was required, however, for third class lever vise construction. To maximize the movement of the open portion of the jaws—or, plates (62, 63)—a leverage system fulcrum (200)—or more specifically, a fulcrum-pivot (64)—was disposed at the plates' (62, 63) opposite extremities holding them (62, 63) together there while they (62, 63) widened or narrowed freely at the top. The nearer the fulcrum (200) the situs of the force was applied (202) by advancing or withdrawing the retraction bolt (65), the greater the range of opening and the speed of operation became; the more the force of the plate's (62, 63) upper tips was lessened, or attenuated; and conversely, the greater the application force (202) was required and the shorter the distance over which it (202) was observed to have been applied. A maximal force-attenuated third class lever vise (61) is conveniently defined herein as one (900) in which the applied force (202) is situated less than thirty percent the distance from the fulcrum (200)—or fulcrum-pivot (64) as more specifically designated with reference to vises—to the clamping uppermost tips of the vise plates (62, 63). As the term suggests, under such circumstances, not only the distance the plate (62, 63) tips are caused to circumferentially move but, conversely, the attenuation of force produced at that site (62, 63) are both maximized. The Rickling device, perhaps borrowing from Jones, Hish and Schneider comprised such a maximized effect arrangement (61). It was a happy discovery that the force needed (202) to accomplish the sought-after result was easily attained by reason of the relatively slow but powerful operable interthreading of the retraction bolt (65).

To make any third class lever vise (900) work, however, certain modifications not required in the more traditional straight-sliding movable plate (63) variety had to be made. It was observed during opening that as the movable plate (63) tipped outward, it (63) cranked down upon the retraction bolt (65), hindering its (65) operation and likely impairing its (65) threads. It, therefore, became necessary to confer upon the moving plate's bolt tunnel (69) a more open vertical oval configuration so that the bolt (65) was permitted to repose within it (69) at an angle. The emergence in Rickling, supra, of the maximal force-attenuated third class lever vise (61) wherein movable plate (63) retraction operated though a tunnel (69) comprising vertical oval configuration was, thus, no surprise. However, by reason of its more elaborate construction, even suggesting, perhaps, the precision-fit parts of a microscope, the Rickling device undoubtedly commanded a respectable retail price.

Positional sleeve and set pin subassemblies are addressed herein in terms of already existing mechanics. It is, thus, stated herein that the combination comprising the invention incorporates both a vertical positioning sleeve and set pin subassembly (4) and a longitudinal one (60). The sleeve (53, 75) is described as longitudinally enwrapping or enveloping the member it (53, 75) couples with—the cradle neck (52) or a sector of the frame's longitudinal component (12), for example. The set pin portion of the phrase addresses either the set screw (94)—in which case the pin is merely threaded and applies its (94) retention force merely by impingement—or the non-threaded sort (93)—which for its (93) retention becomes seated, or accommodated, within a selected one of a series of suitably sized and spaced-apart receptor holes (92) drilled into the frame's longitudinal component (12), support rod vertical extension (31) or cradle neck (52). Where tubular components (13, 14) are employed in construction, threaded mounted nut apertures (97) may be disposed at the connection site to accommodate a threaded pin (94). These (97) comprise merely the attachment—usually welded—of a reinforcing threaded hexagonal or other nut over what would otherwise remain as the bare threaded set pin aperture (95). Any of these accommodating versions provides a dependable connection, satisfying the definition of rigid emplacement herein, supra. Because the choice herein between one or the other of those long-time prior art mechanical adjustment devices is, as it should be, a matter of indifference, the set pin portion of the subassembly phrase is generically expressed as a convenience.

The firearm support currently needed is a more economical combination of many of the already extant features in the field together with simple gadgetry permitting them to work as well as their more costly counterparts. The frame should be of stable construction with two members disposed generally orthogonally (800) in the same plane such as represented by the T-configuration (1) featured by Kilby, Bell, Abernethy, Looney and Jacobs, preferably comprising fine positioning capabilities for camber and precise frontal and rearward elevation. As in some of the prior art models, the assembly should permit rough positioning both in the frontal vertical and inter-relational longitudinal sense and be light enough to permit quick and practical shifting about for generalized azimuth positioning, if required. The firearm (100) should be firmly gripped at the framework's (800) rearward sector by quick-to-operate leveraged maximal force-attenuated third class lever means (61) to cheaply but expeditiously fulfill the functions of the vise of the elaborate, more expensive Rickling firearm support, in permitting generous working space at the retention site when open. For operational convenience, the gripping mechanism should preferably further incorporate convenient spring biased unclamping means, perhaps derivable from those of Hish. The sought-after economy of construction for the assembly should be achieved through the incorporation of readily available, rugged and inexpensive commercial materials such as tubular bar-stock (13, 14), hollow clamping components and the like. The assembly should comprise inexpensive constituents which provide what is generally respected as dependable "positive" control, facilitating vise retraction bolt (65) operation to advantageously tip, or tilt inward and outward, the vise's movable plate (63) as well as a firm passageway for fine positioning bolt assemblies (7).

The firearm support assemblies of prior art have surely gone far in fulfilling substantial sighting, maintenance, exhibition and stowage needs and objectives. Yet, those pointed out supra thus far remain only addressed only in the most collective sense. While most of the needs and objectives have been separately met in one way or another, the assemblies most nearly incorporating the totality of them fail to meet that paramount one of economic availability.

SUMMARY OF THE INVENTION

The invention which is the subject matter hereof comprises a support framework upon which a firearm (100) may be mounted for inspection, repair, sighting and other related tasks. As with at least one of its predecessors, it comprises a maximal force-attenuated third class lever vise (61) extending upwardly from the framework (800) within which the firearm (100) stock may be secured. A rotable lag cylinder (68) is installed within the vise's movable plate (63) so as to cooperate with the vise's retraction bolt's (65) advance and withdrawal in the vise's (61) opening and closing operation.

The components in large part, are preferably constructed of relatively inexpensive tubular bar-stock (13, 14) the cut ends of which may be capped with appropriately shaped pieces (15, 16, 77).

Several points of adjustment are present. The entire vise-work itself (61) may be slid forward and backward along the frame's longitudinal component (12) and then retained by means of a sleeve and set pin subassembly (60). A similar subassembly (4), provided at the front, permits raising and lowering the cradle (5) upon which the firearm (100) barrel rests along an upward extending framework member (31). Preferably, both lateral components (11)—that is, left and right—and the rearmost portion of the longitudinal one (12) of the orthogonally configured frame (800)—T-shaped (1) also by preference—adjust to correct for height, pitch and camber by means of fine vertical positioning bolt assemblies (7). Where tubular bar-stock (13, 14) is employed, the threaded components of these adjustors (7) are preferably retained in their passage within screw anchoring channel blocks (98) disposed therein (13, 14).

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

In FIG. 1, the vise plates (62, 63) are separated sufficiently to accommodate the firearm (100), so that the coil-spring (66) is shown expanded into its (66) partially biased-open state and the bolt (65) slightly retracted from the position occupied in FIG. 2. The assembly is shown in both renderings to comprise positional sleeve and set pin subassemblies both of vertical and longitudinal application (4, 60, respectively). The set pin of that portrayed in FIG. 1 is of the threaded impinging sort (94), while that (93) of FIG. 2 is non-threaded for positional insertion into provided receptor holes (92). Both drawings also incorporate fine vertical positioning bolt assemblies (7) at the ends of members of a T-frame (1) for leveling and other adjustments. The one (7) in the foreground has been cut away in FIG. 2 to unblock the view of the vise's fulcrum-pivot (64). FIG. 1 reveals the cut ends to be covered with caps (15, 77, respectively) both for the squared bar-stock (13) of the frame (800) and the vise plates (62, 63), while FIG. 2, shows them left uncovered to disclose, among other things, screw anchoring channel blocks (98) for proper seating of the threaded portion of the positioning assemblies (7). The assembly's firearm (100) supporting faces are padded (72) in both figures.

Figure 3:
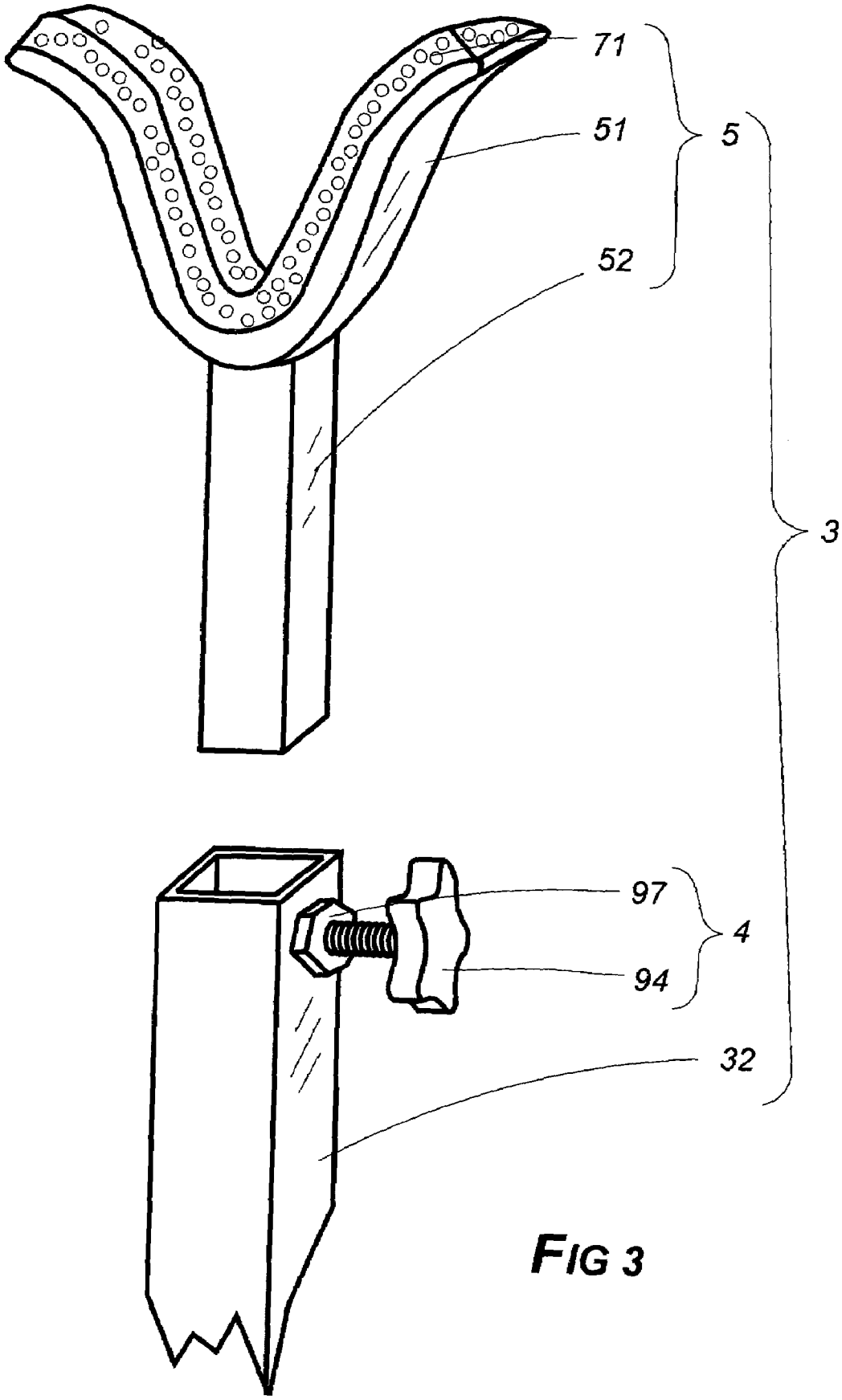

In the view of the front support (3) presented in FIG. 3, the cradle (5) is shown with its neck (52) separated from the positioning sleeve (53) into which it (52) slides for connection to attain the positioning shown in the first two drawings. The vertical positioning sleeve and set pin subassembly (7) is also shown again, this time comprising a threaded mounted nut aperture (97).

Figure 1:
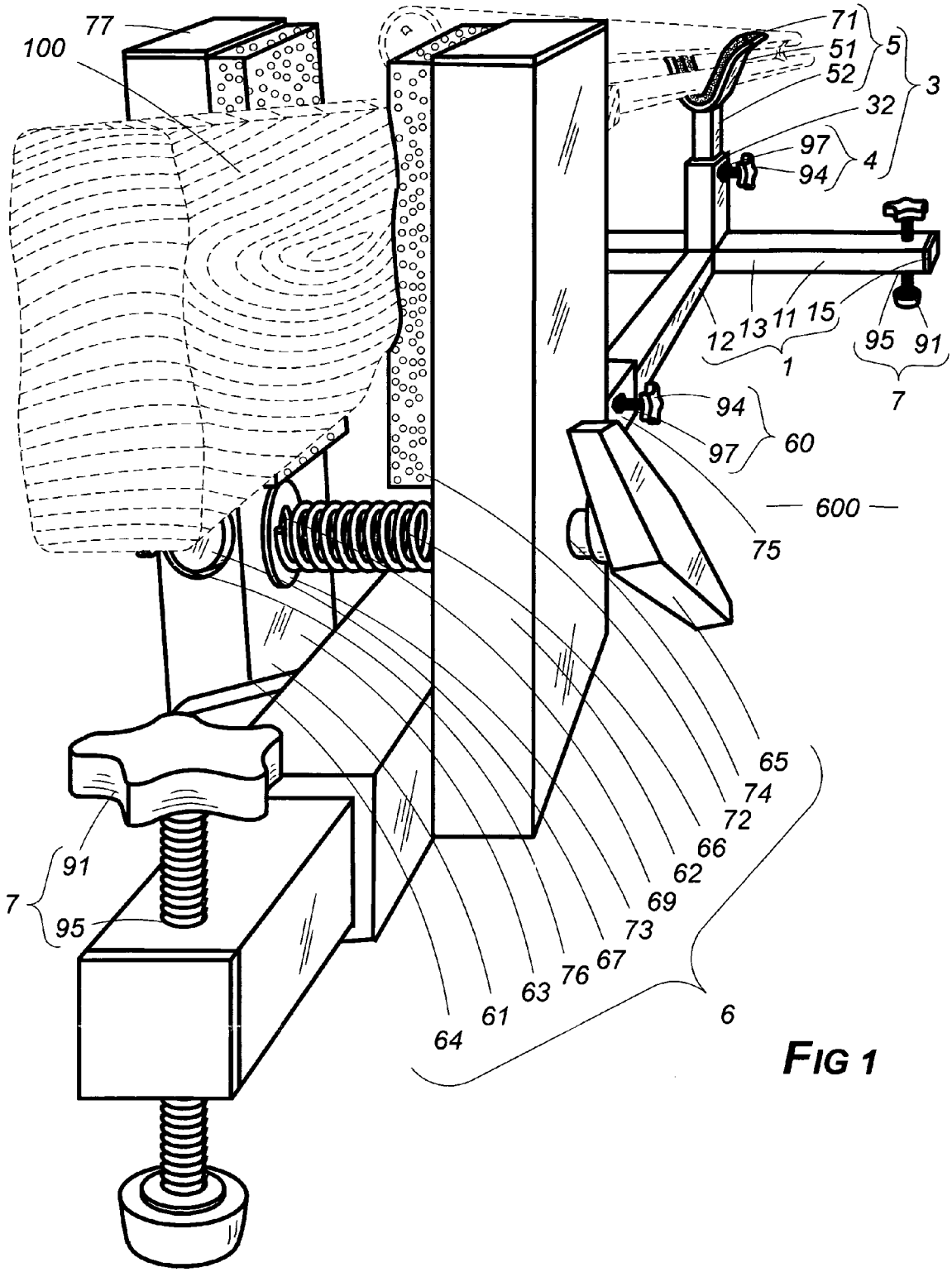
FIGS. 1 and 2 represent in perspective an embodiment of the invention illustrating the assembly's vise (61) in firearm (100) securing and non-securing modes, respectively.
Figure 2:
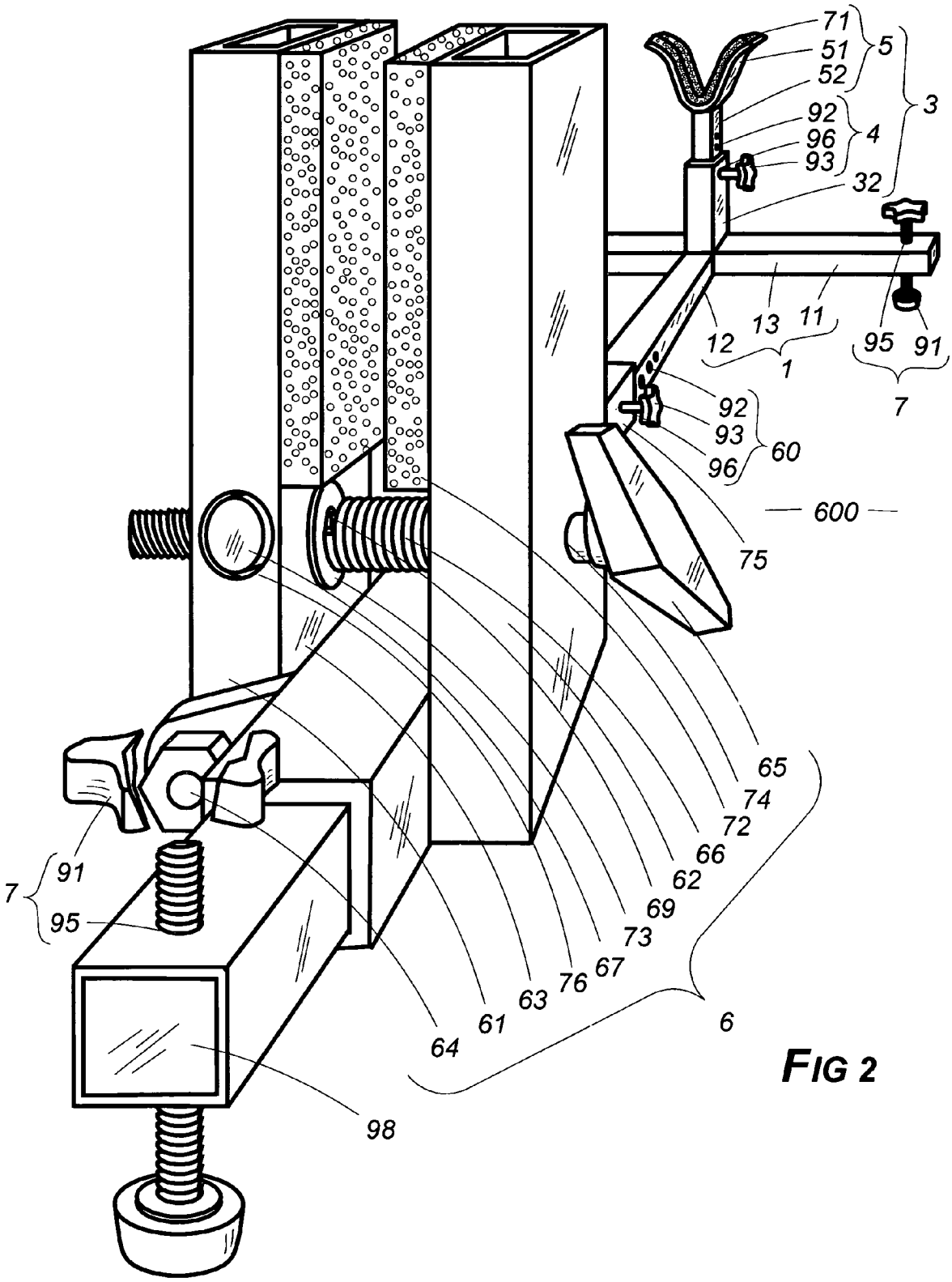
Figure 4:
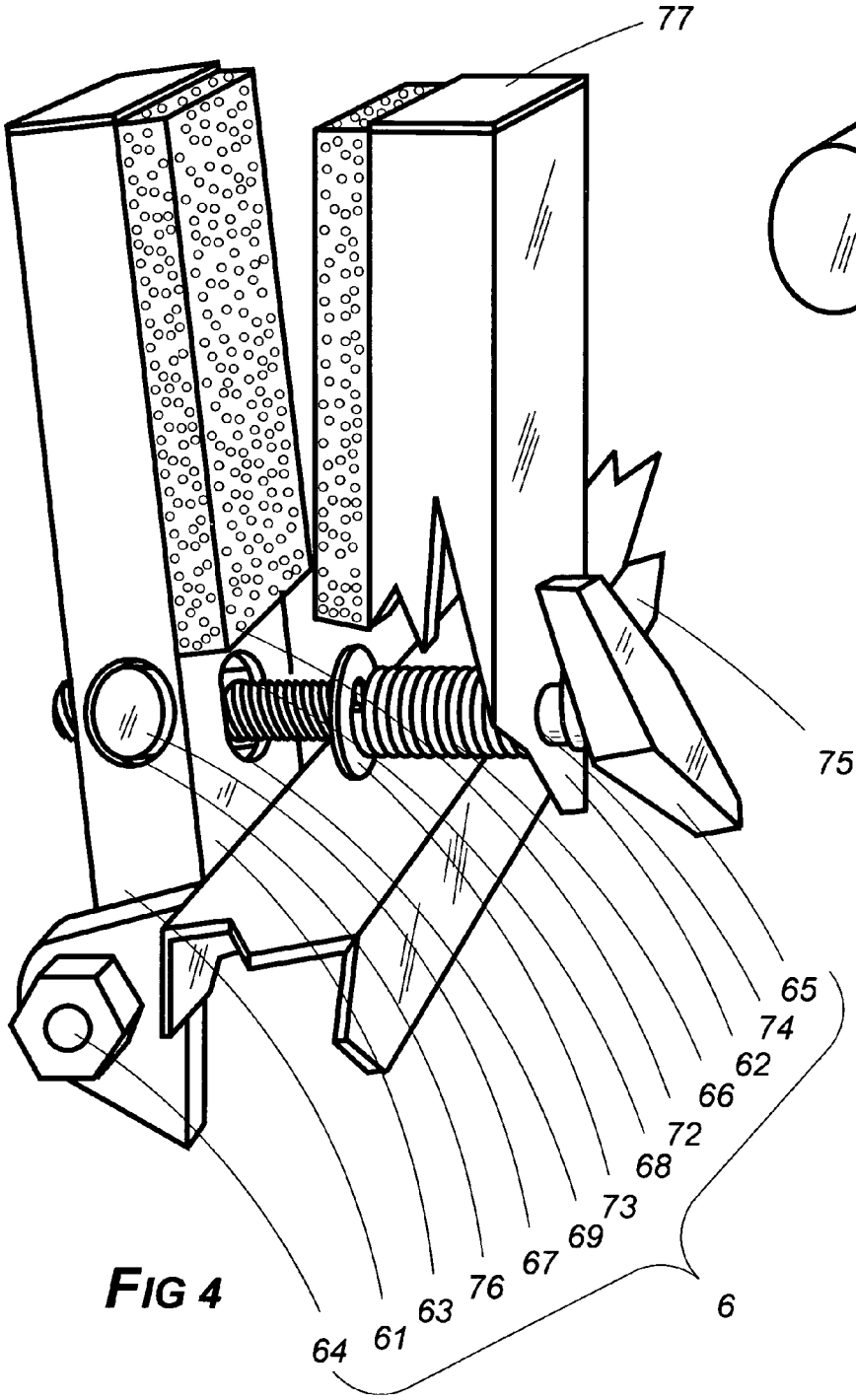

FIG. 4 portrays the vise (61) widely opened so that the movable plate (63) is allowed to recline considerably outwards. The fixed plate (62) and frame's longitudinal component (12) are shown in cut-away to reveal the vise's (61) inner workings. The coil-spring (66) is shown compressed and the spring stop (73) pulled up against it (66) so that the plate's oval tunnel (69) and vise lag cylinder (67) with its threaded tunnel (68) can be observed. As in FIGS. 1 and 2, the leveraged applied force site (202)—that associated with the retraction bolt (65)—is shown disposed less than 30 percent of the distance from the fulcrum-pivot (64) and the plates' (62, 63) uppermost extremities, thereby characterizing the vise as a maximal force-attenuated one (61), supra.

Figure 5:
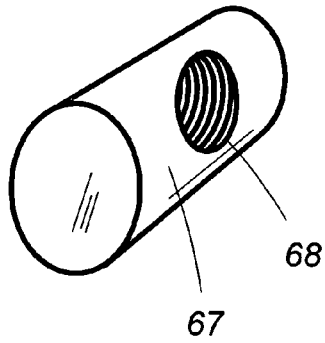

FIG. 5 comprises the lag cylinder itself (67), illustrating the thread-work within its tunnel (68).

Figure 6:
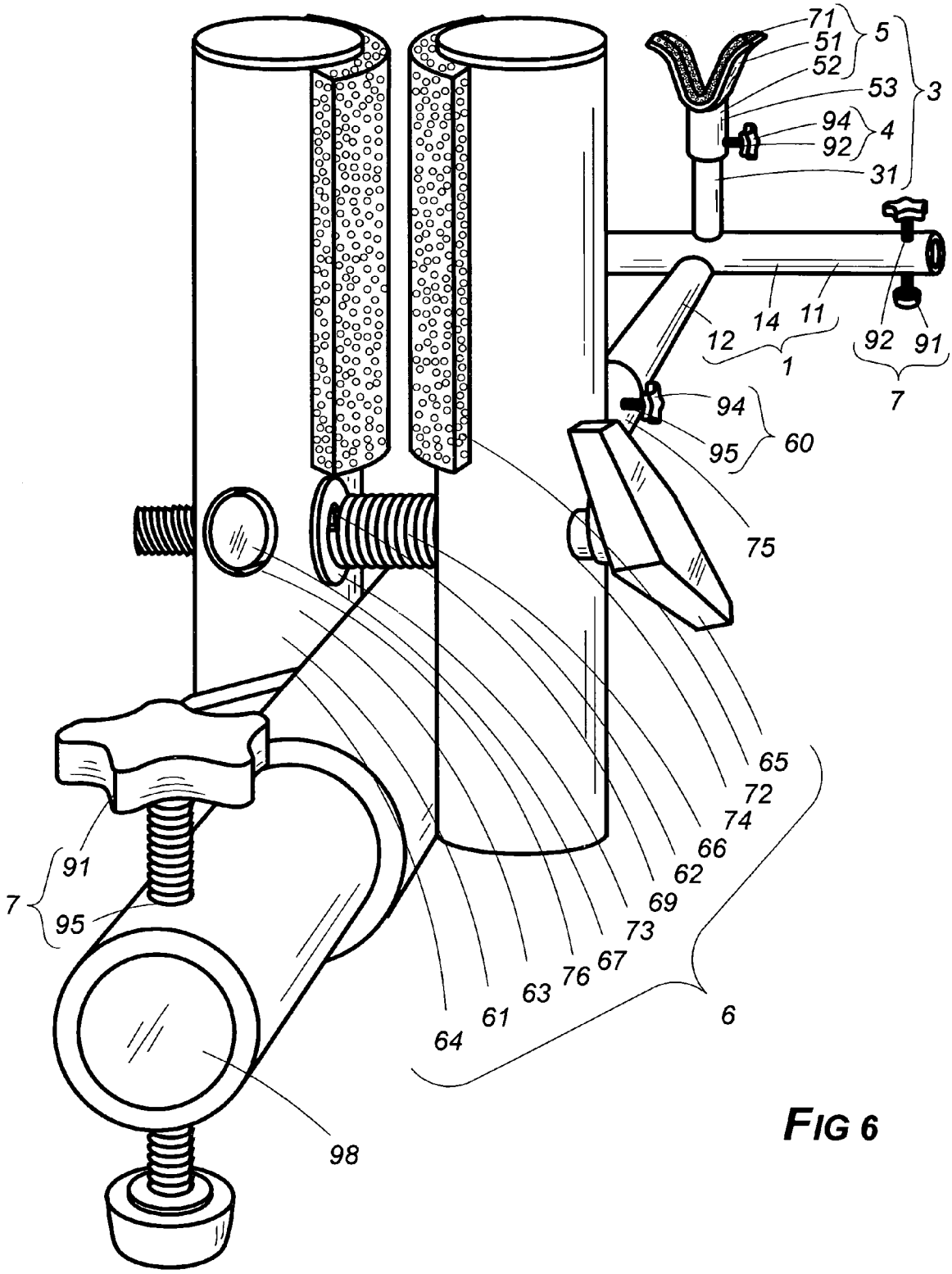

FIG. 6 represents an embodiment in which the assembly's framework comprises round tubular bar-stock (14)—such as plastic pipe known as PVC and the like—rather than the squared sort (13) shown in FIGS. 1-4, 7 and 8.

Figure 7:
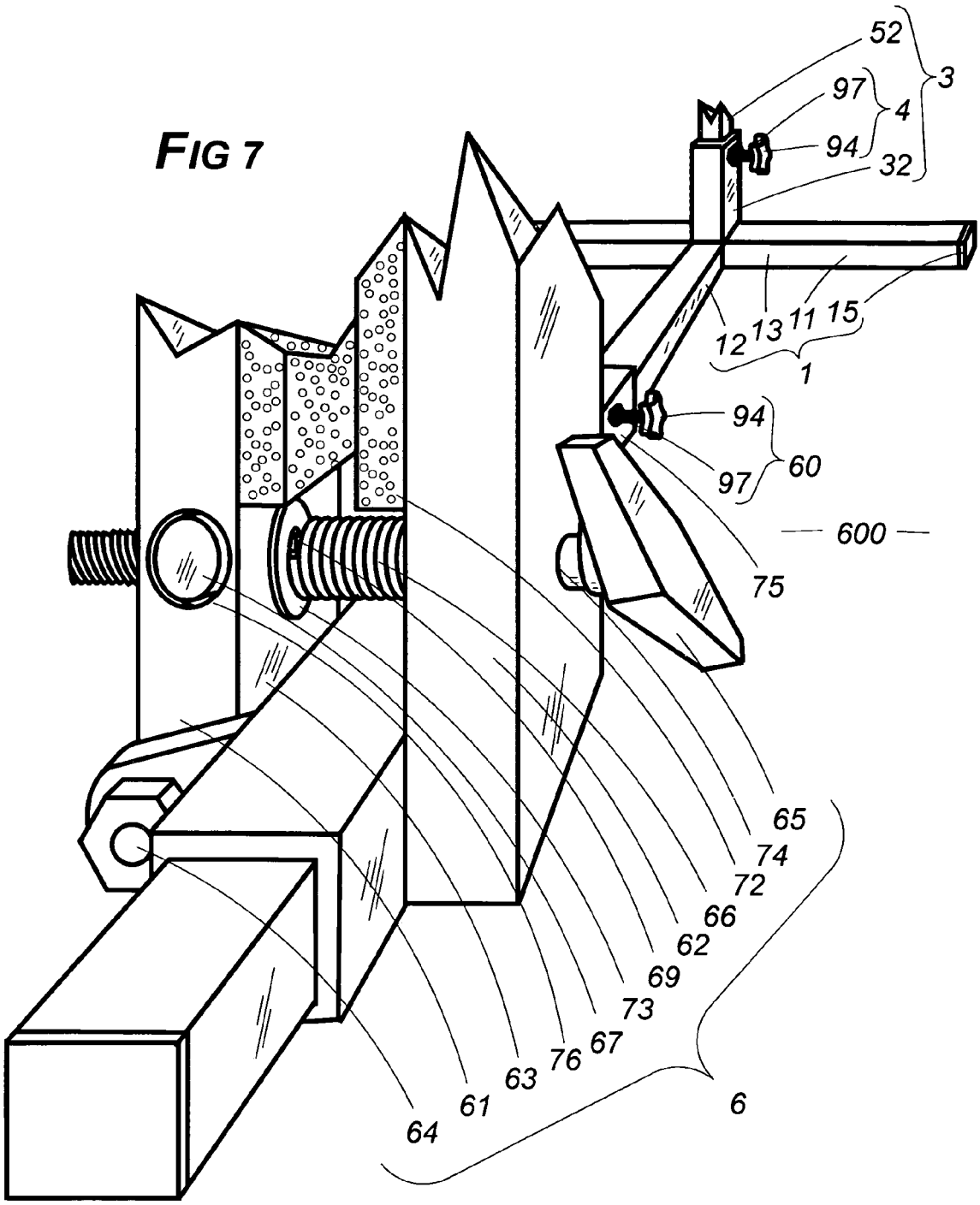
Figure 8:
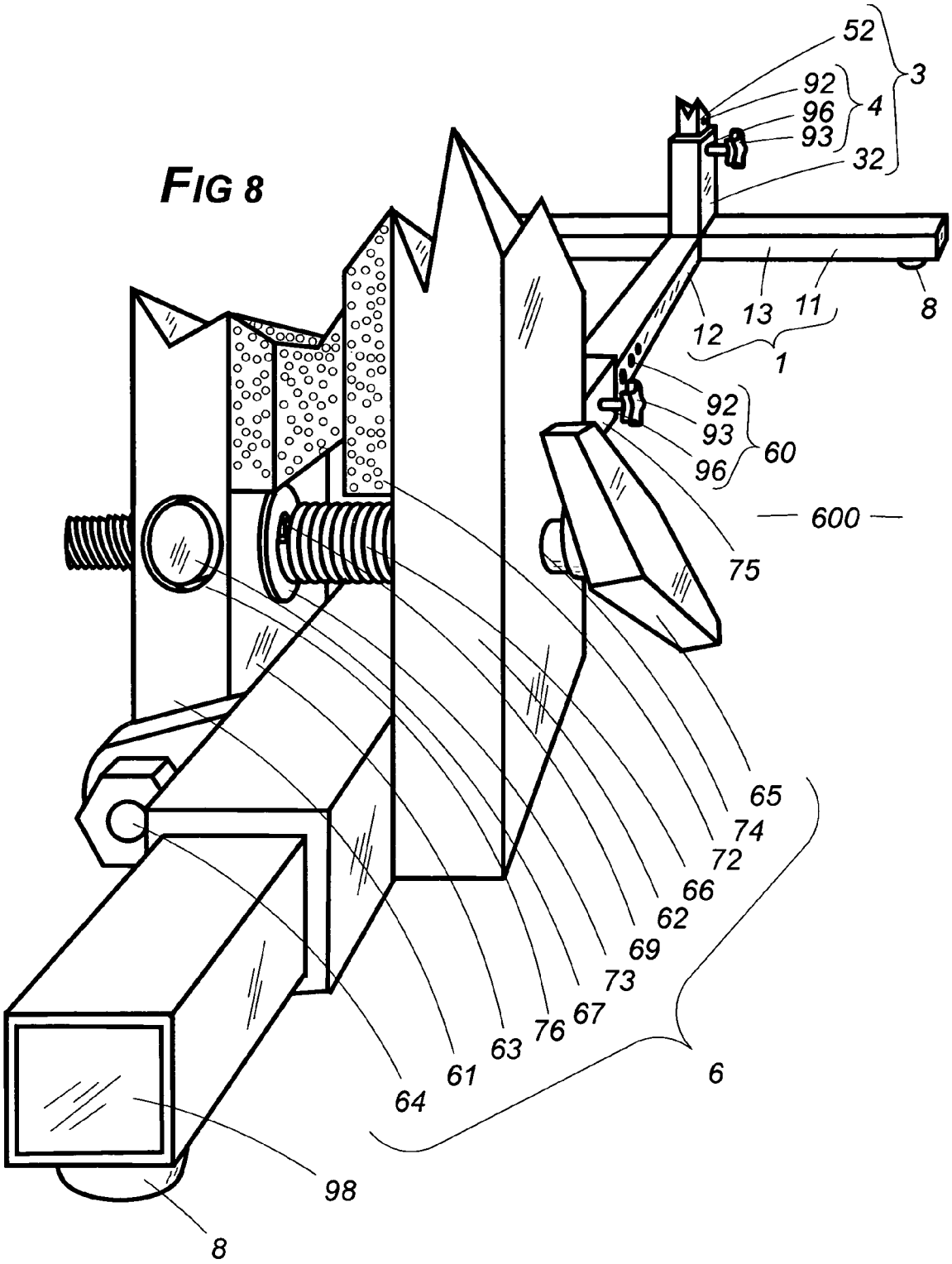
Figures 9, 10, 11:
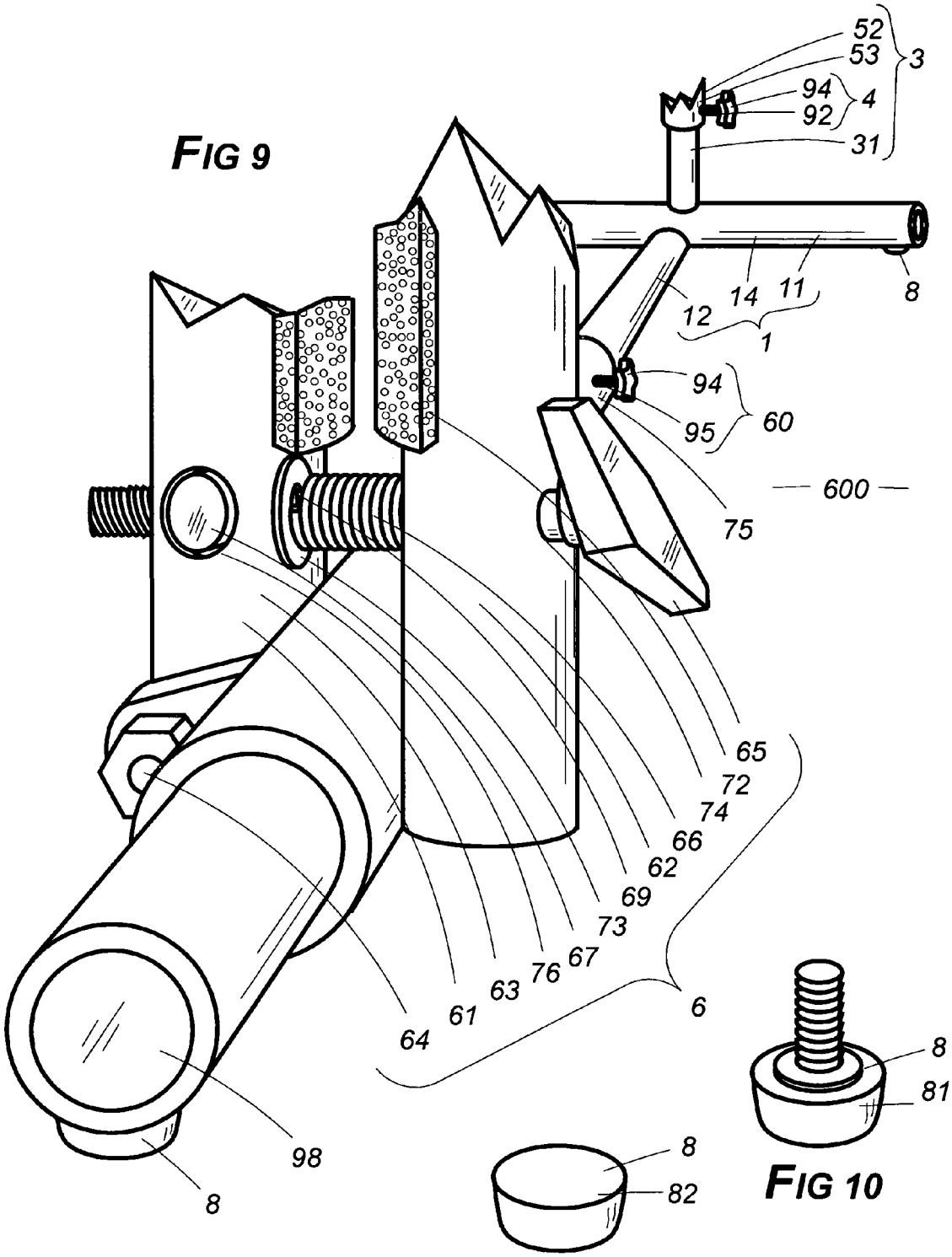

FIGS. 7-9 comprise cut-away perspective views of lesser preferred assemblies in which fine vertical positioning bolt assemblies (7) are absent. In FIG. 7, the least preferred of the three, the frame (1, 800) rests directly upon the underlying surface (600). The movable vise plate (63), in this arrangement, should preferably be displaced slightly upwards to allow room for the plate's (63) outward tilt, ante. In FIGS. 8 and 9, the framework (1, 800) rests upon support spacers (8) specifically indicated by the presence of anchoring channel blocks (98) to be the spacing screw (81) type. They (8) are shown disposed at the points otherwise occupied by the members of fine vertical positioning bolt assembly (7) shown in FIG. 1 and are, respectively, separately shown in both as a spacing screw (81) and an adhesive spacer (82) in FIGS. 10 and 11.

Figure 12:
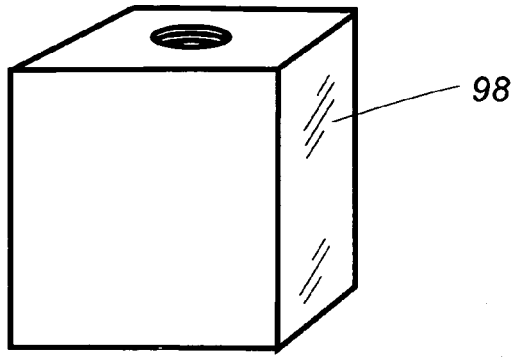
Figure 13:
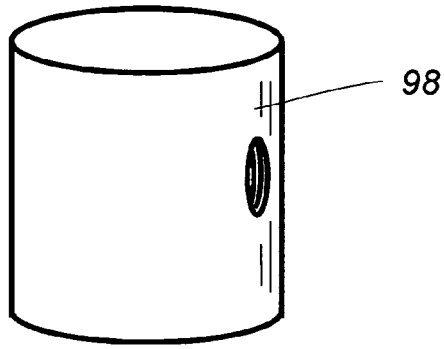

FIGS. 12 and 13 illustrate cubically and cylindrically configured screw anchoring channel blocks (98), formed to fit, respectively, into squared (13) or round (14) bar-stock framework.

Figure 14:
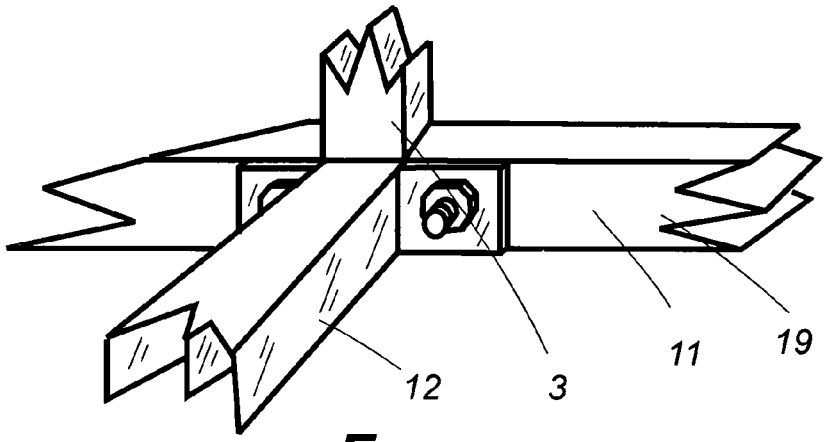

In FIG. 14, the framework, shown in cut-away, is of solid (19) composition rather than of tubular (13, 14) bar-stock configuration.

Figure 15:
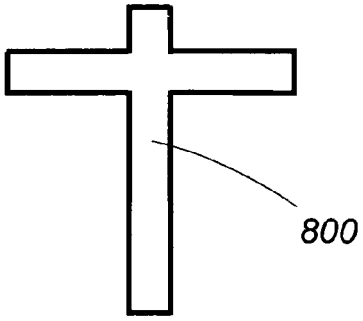
Figure 16:
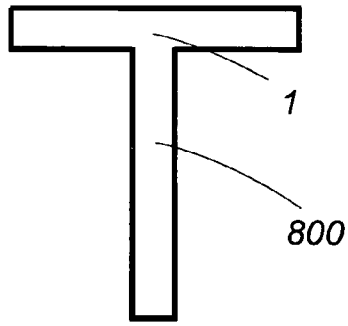

FIGS. 15 and 16 depict symbolically different versions of orthogonally configured frames (800), the latter of the two comprising the preferred T-shaped one (1).

Figure 17:
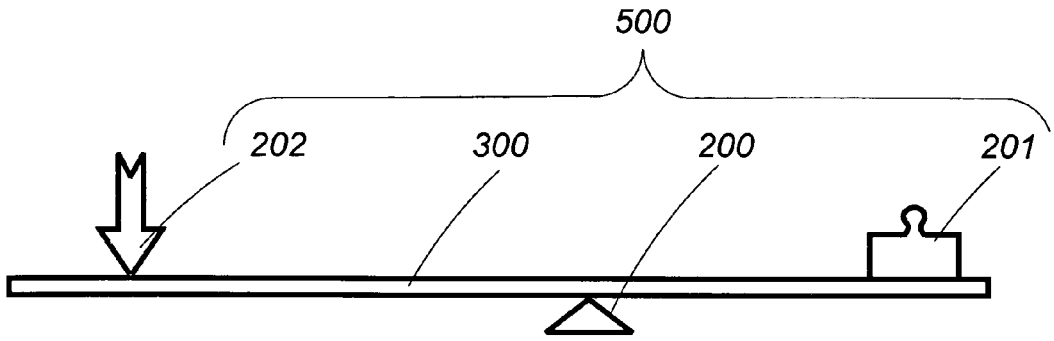
Figure 18:
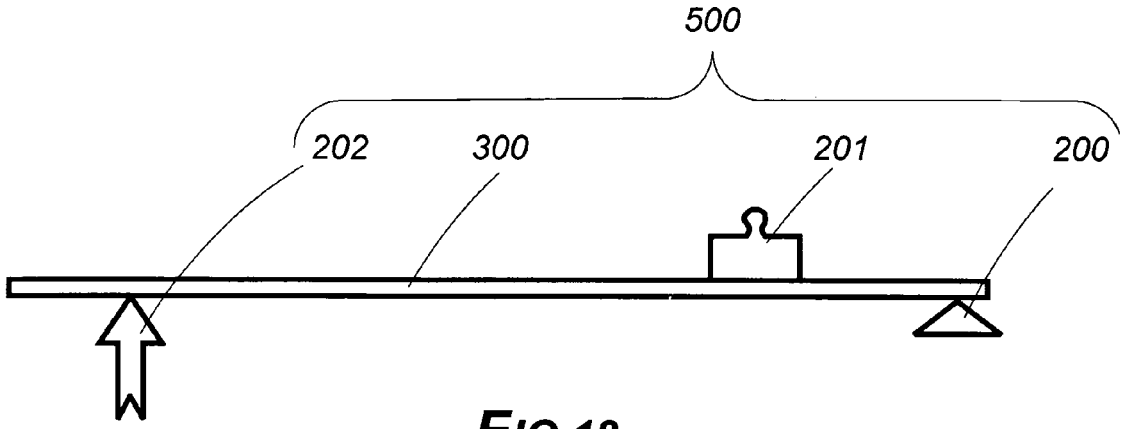
Figure 19:
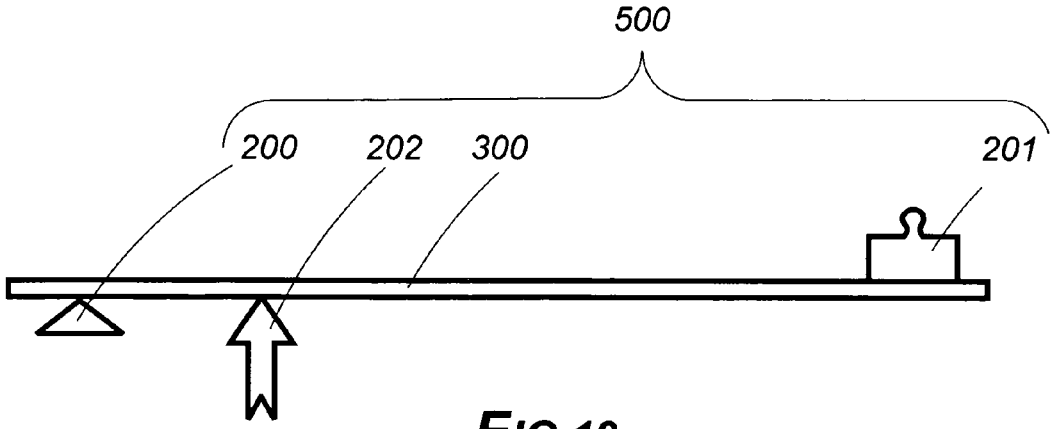

FIGS. 17-19 illustrate the principles distinguishing the three types of leverage systems (500) by allocating the disposition of the functional members thereof—the fulcrum (200), weight (201) and applied force (202)—to appropriate respective sites.

DESCRIPTION OF THE PREFERRED EMBODIMENT

The subject of this application comprises a framework assembly upon which a firearm (100) may be emplaced for repair, scope leveling and alignment, firing and sighting adjustment or merely for display.

The framework, horizontally disposed, is in the two-dimensional sense, of generally orthogonal configuration (800), the opposing longitudinal extremities of which are herein considered for purposes of orientation as front and rear. The framework's lateral component (11) is joined to the longitudinal one (12) at the frontal sector, most preferably at the very front, these two mutually attached members (11, 12) thereby conferring upon the assembly a T-shape (1). Although solid (19) members—such as the frame (1, 800), vertical extension (31) and vice plates (62, 63)—are acceptable for the orthogonal construction (800), it (800) is preferably and more practically comprised of lighter weight and cheaper tubular bar-stock of squared (13) or rounded (14) cross-section.

An upwardly extending front support (3) is frontally disposed by attachment of a vertical extension (31) comprised by it (3) upon the framework (1). It (31) is upwardly disposed, preferably orthogonally with reference to the lateral and longitudinal components (11, 12) at the latter's (12) foremost extremity, a point comprising the intersection of the two.

A cradle (5) comprised also as part of the front support (3) is disposed atop the vertical extension (31) and comprises a generally horizontally disposed firearm barrel rest (51)—which, if desired, may comprise a V-shape—disposed for support by attachment upon a downwardly extending cradle neck (52) in turn connected to the vertical extension (31).

With reference to this connection, in the preferred arrangement, the front support (3) comprises a vertical positioning sleeve and set pin subassembly (4) as that term is defined herein, supra, to adjust the height of the cradle (5) as the neck (52) is raised or lowered in sliding along within a front support sleeve (32). A sleeve and set pin subassembly (4) is, of course, also employed in an alternative arrangement in which, conversely, the cradle (5) comprises a positioning sleeve (53) which is slid up or down over the front support's vertical extension (31), properly configured to fit within the sleeve (53) for the raising or lowering adjustments.

The rear support (6), oppositely disposed to the front one (3) along the assembly's longitudinal aspect, comprises in the main, an upwardly extending maximal force-attenuated third class lever vise (61), disposing its applied force approximately one-quarter the distance from the fulcrum-pivot (64) to the movable plate's (63) upper extremity—or height. The fixed plate (62) and fulcrum-pivot (64) are attached to the sleeve (75) of the longitudinal positioning sleeve and set pin subassembly (60) in lateral opposition to one another (62, 64). The fixed and movable plates (62, 63) are biased apart by a coil-spring (66) more or less longitudinally disposed upon the vise bolt's (65) longitudinal aspect. A spring stop (73), a large washer or the like, is provided to overlie the movable plate's oval cutout (69) to prevent the spring's (66) becoming fouled within it (69). The inwardly disposed surface of the fixed plate (62) comprises an acceptable stop for the spring's (66) opposing end.

To enable the bolt's (65) proper retraction, a vise lag cylinder (67) comprising a threaded interior tunnel (68) is present within the movable plate (63). To that end, this plate (63) comprises a generally horizontal and transversely disposed lag cylinder seating tunnel (76). Its (76) transverse disposition is such that it (76) generally parallels the frame's longitudinal component (11)—that is, situated in rear-to-front orientation, passing through the plate's (63) width. It (76) is formed to permit the lag cylinder (67) to be longitudinally slid into and emplaced within it (76). The cylinder's (67) fit within the moving plate's seating tunnel (76) is somewhat snug but with sufficient play to permit it (67) to give rotably as the movable plate (63) pivots outward or inward in response to the retraction bolt's (65) advance or withdrawal. The cylinder itself (67) comprises a threaded diametric tunnel (69) disposed for interthreading engagement by the retraction bolt (65). Because no compelling need appears for a cammed operation, the cylinder's threaded tunnel (68) is preferably disposed within its (67) interior diametrically. To facilitate drilling of the various tunnels (68, 74, ante) through the plates (62, 63), for the sake of economy in manufacture and to favor-portability by keeping the assembly's weight down, hollow construction for them (62, 63) is preferred. By reason thereof, the dependable "positive" control highlighted among the sought-after objectives, supra, might be lost were it not for this rotable lag cylinder member (67). Its (67) rotable emplacement and the threaded tunnel (68) within provide as high a degree of operational assurance as would likely be present with the heavier more traditional solid vise plates (62, 63).

Like the features enabling cradle (5) height adjustments, the assembly also comprises a longitudinally disposed positioning sleeve and set pin subassembly (60). The portion of the rear support (6) to which the fixed vise plate (62) is attached, therefore, comprises a tubular positioning sleeve (75) of sufficient cross-sectional dimension to enable it (75) to slide along in near-snugness forward and backward over the framework's longitudinal component (12). Configured open at each end, it is possible to position the sleeve (75) at any point along that component (12) except, of course, where such movement is blocked by the front support (3) or a support level pin (91), ante, disposed at the rear. It is, therefore, appropriate to state in shorthand that the assembly comprises in part a longitudinal positioning sleeve and set pin subassembly (60) disposed to engage in longitudinally enveloping fashion any unobstructed portion of the longitudinal component (12) of the T-shaped frame (1).

Preferably, the assembly further comprises a number of fine vertical positioning bolt assemblies (7) upon the framework-most preferably, three of them (7), one proximate each extremity of the frame's lateral component (11) and one at the rear extremity of the longitudinal one (12)—thereby a providing a stable triangular base of adjustment stability. As an interthreading aid where tubular bar-stock (13, 14) is employed in construction, a threaded tunneled screw anchoring channel block (98) is preferably disposed within the tubular members to accommodate the support level pin (91) at each adjustment site. This tunneled block (98), thus, provides the welcomed "positive" interthreading control similar to that observed with the vise lag cylinder (67), supra.

When no fine vertical positioning bolt assembly (7) is present, the frame (800) would ordinarily rest directly upon the underlying surface (600). While this is an acceptable disposition so long as sufficient underlying clearance for vise operation is provided, experience suggests the advisability of at least substituting support spacers (8) for the positioning assembly (7) members. The spacers (8) may take any shape but, for reasons of durability, preferably comprise a disk-like configuration attachable by means providing threaded engagement with anchoring channel blocks (98). Otherwise, they may comprise merely an adhesive spacer (82) for the attachment. If desired, they (8) may also comprise padding for contact with the underlying surface (600).

The firearm (100) may be protected from marring or other damage by providing soft, pliable cushioning at the cradle's barrel rest (51) and vise plates (62, 63). A cradle pad (71) and vise pad (72) are, therefore, preferably disposed upon the respective firearm (100) contacting surfaces.

In embodiments in which tubular bar-stock (13, 14) comprises the framework (1) members, exposed component (11, 12) cut ends are preferably covered with caps (15, 16) to avoid scratching the operator or nearby objects as well as an aesthetic measure. Similar caps (77), appropriately shaped, are preferably provided for vise plates (62, 63) of hollow construction.

The invention claimed is:

1. A firearm support assembly comprising a frame of general horizontal orthogonal configuration, thereby comprising mutually attached longitudinal and lateral components;

a front support; and a rear support;

the front support comprising a cradle in turn comprising a generally horizontally disposed firearm barrel rest supported upon a downwardly extending neck;

a vertical extension disposed by attachment to the frame; and a vertical positioning sleeve and set pin subassembly wherein the height of the cradle is adjusted and rigidly emplaced along a vertical portion of the frontal support;

the rear support comprising a longitudinal positioning sleeve and set pin subassembly wherein the rear support's disposition is adjusted and rigidly emplaced along the frame's longitudinal component;

a maximal force-attenuating third class lever vise comprising a fixed plate;

a movable plate;

a retraction bolt;

a fulcrum-pivot;

an elongated coil-spring; and a lag cylinder;

wherein the fixed plate and fulcrum-pivot are attached to the sleeve of the longitudinal positioning sleeve and set pin subassembly's in lateral opposition to one another; the coil-spring is biased to force the fixed and movable vise plates apart and the retraction bolt thereof is longitudinally disposed within the coil-spring; the lag cylinder is disposed by rotable emplacement within the a lag cylinder seating tunnel disposed in turn within the movable plate generally parallel the assembly's longitudinal component; and the cylinder is configured in turn with a threaded diametric tunnel within which the retraction bolt is caused to interthread, whereby the movable plate's uppermost extremity is caused by reason of the screw retraction principles to circumferentially tilt inward and outward upon the bolt's respective advance or withdrawal.

2. The firearm support assembly according to claim 1 further comprising a plurality of support spacers disposed to provide a base suspended upwards from the underlying surface.

3. The firearm support assembly according to claim 1 further comprising a plurality of fine vertical positioning bolt assemblies disposed to provide a base of adjustment stability.

4. The firearm support assembly according to claim 1 wherein the frame's orthogonal configuration comprises a T-shape.

5. The firearm support assembly according to claim 1 comprising tubular members and one or more screw anchoring channel blocks disposed within them to accommodate the support level pin of each fine vertical positioning bolt assembly.

6. The firearm support assembly according to claim 1 wherein the base of adjustment stability provided by the disposition of the fine vertical positioning bolt assemblies is triangular.

7. The firearm support assembly according to claim 1 wherein the cradle's firearm barrel rest is V-shaped.

8. The firearm support assembly according to claim 1 wherein the cradle's neck comprises the sleeve of the vertical positioning sleeve and set pin subassembly and is configured and disposed to longitudinally envelope the assembly's vertical extension.

9. The firearm support assembly according to claim 1 wherein the vertical extension comprises the sleeve of the vertical positioning sleeve and set pin subassembly and is configured and disposed to longitudinally envelope the cradle's neck.

10. The firearm support assembly according to claim 1 wherein one or more members of the frame, vertical extension and vise plates comprise solid configuration.

11. The firearm support assembly according to claim 1 wherein one or more of the positioning sleeve and set pin subassemblies comprise a series of receptor holes to accommodate a non-threaded pin.

12. The firearm support assembly according to claim 1 wherein the cross-sectional configuration of the assembly's members is square.

13. The firearm support assembly according to claim 1 wherein the front support's vertical extension is generally orthogonally disposed at the intersection of the T's longitudinal and lateral components.

14. The firearm support assembly according to claim 1 further comprising a cradle pad and a vise pad.

15. The firearm support assembly according to claim 1 wherein one or more of the positioning sleeve and set pin subassemblies comprises threaded mounted nut apertures disposed to accommodate a threaded pin.

16. The firearm support assembly according to claim 1 wherein the distance from the fulcrum-pivot to the point of applied force provided by the retraction bolt is not greater than one-quarter the height of the movable plate; thereby further attenuating the gripping force at the plate's uppermost extremity.

17. A firearm support assembly comprising a T-shaped frame;

a front support; and a rear support;

the front support in turn comprising a cradle the height of which is adjustable by means of a vertical positional sleeve and set pin subassembly;

the rear support in turn comprising a longitudinal positioning sleeve and pin subassembly for positional adjustment along the frame's longitudinal component; and a maximal force-attenuating third class lever vise disposed by attachment to the sleeve of the positioning subassembly;

the assembly further comprising a rotable vise lag cylinder disposed within a vise lag cylinder tunnel in turn disposed within the vise's movable plate and oriented in disposition generally parallel to the frame's longitudinal component; the lag cylinder comprising a diametrically disposed threaded tunnel within which the vise's retraction bolt is configured and disposed to interthread; wherein, by reason of the cylinder's rotability and the vise's retraction bolt's interthreaded engagement with it, the vise's movable plate is caused to tilt inward and outward without cranking against the bolt upon its respective advancement and withdrawal;

the assembly further comprising one or more fine vertical positioning bolt assemblies disposed upon the frame to permit adjustment in leveling and camber; and screw anchoring channel blocks disposed to accommodate the support level pin of each thereof.

* * * * *